United States Patent [19]

Gentry

[11] Patent Number: 5,058,664

[45] Date of Patent: Oct. 22, 1991

[54] RODBAFFLE HEAT EXCHANGER

[75] Inventor: Cecil C. Gentry, Bartlesville, Okla.

[73] Assignee: Phillips Petroleum Company, Bartlesville, Okla.

[21] Appl. No.: 552,045

[22] Filed: Jul. 13, 1990

[51] Int. Cl.[5] ..... F28D 7/00

[52] U.S. Cl. ..... 165/162; 165/158; 165/134.1

[58] Field of Search ..... 165/158-162, 165/134.1

[56] References Cited

U.S. PATENT DOCUMENTS

| | | | |
|---|---|---|---|
| 2,864,589 | 12/1958 | Booth et al. | 165/160 X |
| 3,735,811 | 5/1973 | Moser et al. | 165/160 |
| 4,136,736 | 1/1979 | Small | 165/162 |
| 4,342,360 | 8/1982 | Gentry et al. | 165/67 |
| 4,398,595 | 8/1983 | Small | 165/109.1 |
| 4,429,739 | 2/1984 | Gentry et al. | 165/159 |
| 4,697,637 | 10/1987 | Young | 165/160 |

FOREIGN PATENT DOCUMENTS

| | | | |
|---|---|---|---|
| 342815 | 2/1931 | United Kingdom | 165/158 |

OTHER PUBLICATIONS

E. A. Barrington, "Acoustic Vibrations in Tubular Exchange", pp. 62-68-7/1973.

Petroleum Refinery Engineering by W. L. Nelson 3/1941-Exchangers, Coolers, Condensers-pp. 393-395.

*Primary Examiner*—Allen J. Flanigan

*Attorney, Agent, or Firm*—Ryan N. Cross

[57] ABSTRACT

A rodbaffle heat exchanger is disclosed in which a plurality of detuning plates are provided to prevent the formation of standing accoustical waves from forming in the shell-side fluid flow path such that vibration and tube damage is prevented.

13 Claims, 2 Drawing Sheets

RODBAFFLE HEAT EXCHANGER

BACKGROUND OF THE INVENTION

The present invention relates to improvements in heat exchangers, and more particularly, to improvements in rodbaffle heat exchangers for preventing undesirable acoustical vibrations from occurring in such heat exchangers. It is known that acoustic resonance may be encountered in shell and tube heat exchangers having a gaseous or two-phase fluid flowing on the shell side when the vortex shedding frequency approaches the acoustic resonance frequency of the flowing gaseous medium. The acoustic resonance frequency is directly proportional to the sonic velocity of the flowing medium and is inversely proportional to the shell diameter. Acoustic resonance oscillations are frequently characterized as standing waves extending across the shell diameter and occurring perpendicular to both the direction of flow and the longitudinal axis of the tube bundle. In addition to objectionable noise, acoustic resonance can also produce damage to tube bundles when the acoustic resonance frequency approaches the natural frequency of the tubes.

There are a number of possible methods for correcting this undesirable condition including changing the flow rate of the fluid flow on the shell side. However, this involves a reduction in flow and is accompanied by reduction in the convective heat transfer. Similarly, the removal of several tubes is possible, but this may also cause unacceptable reduction of heat transfer, and is extremely difficult and expensive when an exchanger is already in operation in the field. Another method involves a construction using irregular lateral spacing of the tubes; however the type of exchangers commonly known as rodbaffle exchangers are much more efficient if such irregular lateral spacing is not practiced. In addition, the prevention of premature failure of tubes due to mechanical stress is taught in U.S. Pat. No. 4,136,736 which is assigned to the assignee of the present application. As used in that patent, the term "baffle" refers to an annular ring to which the ends of a plurality of rods are connected; hence the term "rodbaffle". Many heat exchangers of this type have been constructed and successfully operated without damage due to vibrations of the tubes. However, under certain operating conditions it is possible that the standing waves of acoustical vibrations mentioned above may exist in such exchangers, such that, the vibration problem may not always be completely prevented by the rodbaffles of the above mentioned patent.

The use of flow-directing baffles in heat exchangers is generally discussed in "Petroleum Refining Engineering" 2nd ed, 1941, by W. L. Nelson published by McGraw-Hill Book Company, Inc. on pages 393–395. Such baffles are laterally extending plates, perpendicular to the axis of the ouier shell, and they extend into the gas flow on the shell side of the heat exchanger in alternate projections from either side of the shell so as to form a generally serpentine flow path. In other figures, the baffles are shown as having a spiral configuration so as to cause an overall spiral or helical flow of the fluid medium. In these baffles, holes are provided through which the tubes of the exchanger are passed, and the holes may be made larger than the outer diameter of the tubes such that some fluid is forced to "scour" the wall of the tube at the baffle location.

More recently, an article entitled "Acoustic Vibrations in Tubular Heat Exchangers" by E. A. Barrington appeared in Volume 69, No. 7 of Chemical Engineering Progress magazine. In this article, the author describes the acoustic vibrations in significant detail, and suggests the use of one or more solid, one-piece baffles extending longitudinally along the axial length of the heat exchanger in order to break up or prevent the occurrence of acoustical standing waves. While such longitudinally extending baffles may solve the problem of acoustical vibrations in the plate baffle type of exchangers to which the author refers, it is not possible or practical to have one or more one-piece, continuous baffles extending the full length of a rodbaffle heat exchanger since such a baffle would cause severe maldistribution of the fluid flow on the shell side. Accordingly, the solution proposed in this article is not adaptable to the acoustical problem should it occur in heat exchangers of the rodbaffle type.

SUMMARY OF THE INVENTION

The present invention relates to the use of a plurality of separate, individual acoustic resonance detuning plates which may be retrofitted in existing rodbaffle heat exchangers, or incorporated during the construction of new rodbaffle heat exchangers. In the preferred embodiments, each separate detuning plate may comprise a sheet of metal which extends axially through one section of the heat exchanger and extends across a chord of the cylindrical exchanger. Additional detuning plates may be located in other sections of the exchanger with the positions of the detuning plates alternating so as to extend across chords above and below the central axis of the exchanger. In another preferred embodiment, first and second pluralities of detuning plates may extend across chords of the exchanger at right angles to each other in the same or alternate sections of the exchanger. In addition, in order to minimize the disturbance or reduction of the flow medium on the shell side of the exchanger, the preferred embodiments of the present invention may include rectangular openings in the plates adjacent the shell wall, plus each plate may be provided with a plurality of holes or ports through which the fluid on the shell side of the heat exchanger may pass in effective heat exchange relationship with the tubes of the exchanger.

DETAILED DESCRIPTION

Figure 1:
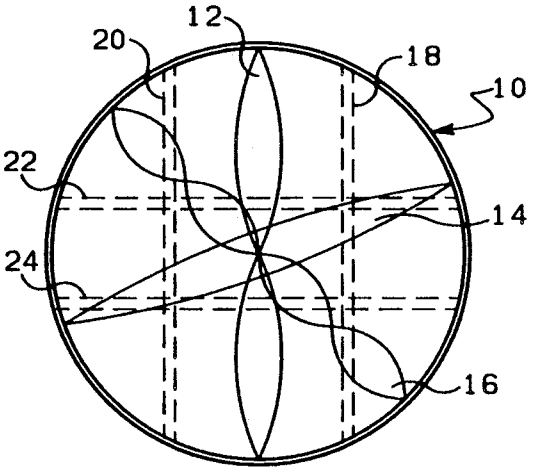
FIG. 1 is a schematic illustration of a cross-section through a cylindrical exchanger showing the acoustical standing waves and how the detuning plates of the present invention, shown in phantom line, thereby prevent such standing waves from occurring.

Referring to FIG. 1, numeral 10 generically refers to a rodbaffle heat exchanger of circular cross-section in which one or more harmonics of standing acoustical waves 12, 14, and 16 are illustrated. Four acoustic detuning plates 18, 20, 22 and 24 are illustrated in phantom line. The mechanical detail and construction of these detuning plates will be subsequently described in detail; however, it will be apparent that depending upon the number of harmonics of standing acoustical waves which are detected in an exchanger as having sufficient amplitude to cause tube damage, one to four detuning plates will be sufficient to prevent the formation of damaging standing waves. It should also be noted from the illustration in FIG. 1, that the preferred location of the detuning plates is within the range of 20% to 43% of the radii of the cylindrical exchanger, and preferably in the order of 33% of the radial distance between the center and the shell of the exchanger as measured along the radii perpendicular to the planes of the detuning plates. Also, it should be noted that the positioning of the detuning plates should not be along any diameter of the exchanger, but rather, should always be along a chord of the circular cross-section of the exchanger.

Figure 2:
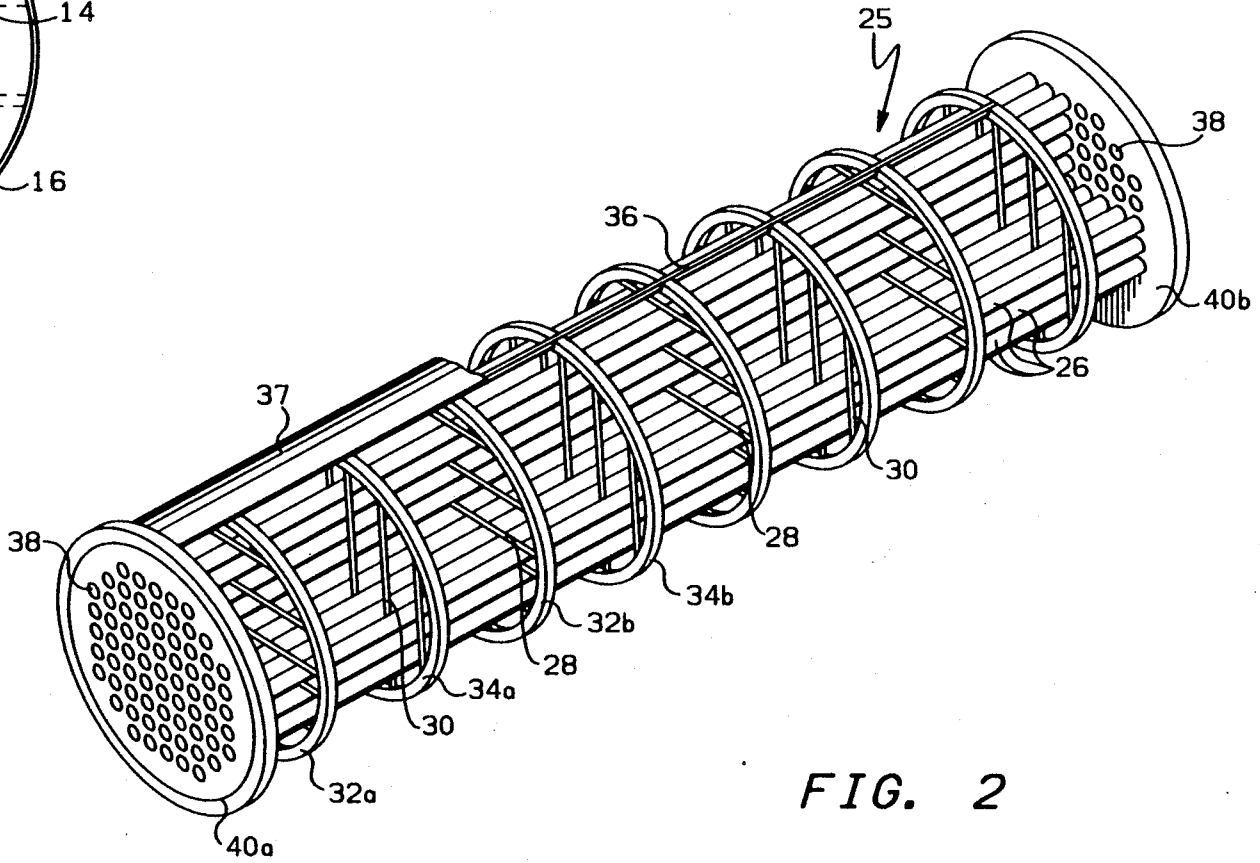
FIG. 2 is a perspective view of a partially assembled rodbaffle exchanger bundle assembly with only a portion of the shell installed around the bundle assembly.

Referring to FIG. 2, a conventional rodbaffle heat exchanger 25 is shown as comprising a plurality of axially and longitudinally extending tubes 26 which are secured as a bundle in the exchanger by a plurality of horizontal rods 28 and vertical rods 30. The ends of horizontal rods 28 are welded or otherwise secured to baffle rings 32*a*, *b*, while the ends of vertical rods 30 are welded or otherwise secured to baffle rings 34*a* and *b*.

As further shown in FIG. 2, it will be understood that the heat exchanger bundle assembly also includes a pair of upper and lower longitudinal tie bars, of which upper tie bar 36 is visible. These bars secure the baffle rings along the longitudinal axis of the exchanger and enable the tube assembly to slide into a surrounding shell. Also, it will be noted that the ends of the heat exchanger tubes are received in holes 38 in tube sheets 40*a* and 40*b* as is conventional practice. Because of the very large number of horizontal and vertical support rods in exchangers of current size, in which the total number of support rods may be in excess of 70, it will be apparent that it would be extremely difficult, if not impossible, to utilize the concept of one or more continuous longitudinally extending baffles for preventing the acoustical vibrations as taught in the Barrington article.

Figure 3:
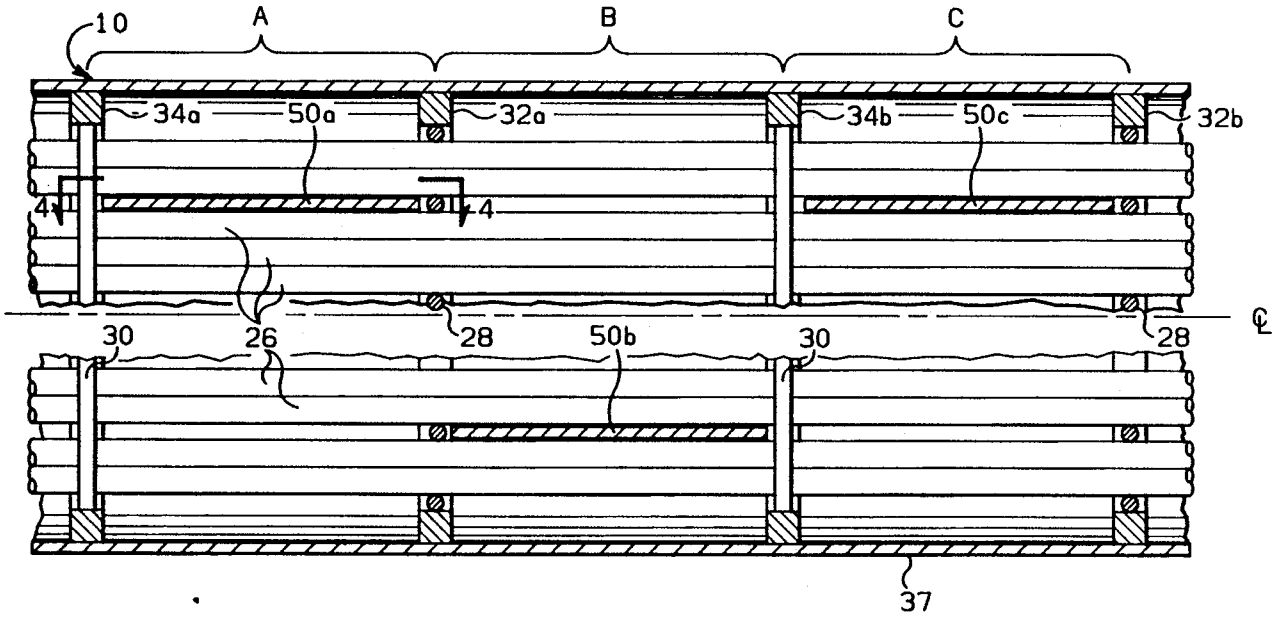
FIG. 3 is a side elevational view, partly in cross-section, of a portion of a rodbaffle exchanger illustrating the alternate-section locations of three detuning plates of the present invention.

Turning now to FIG. 3, a portion of an exchanger bundle is shown in cross-section as comprising three sections A, B and C which are defined as the longitudinal spaces between baffle rings 34*a* and 32*a*, and similarly, between each of baffle rings 32*a*–34*b* and 34*b*–32*b*. FIG. 3 also shows the exchanger bundles as surrounded by a shell 37 having a circular cross-section. Acoustical detuning plates 50*a*, 50 *b* and 50*c* are illustrated as extending laterally across chords of the cross-sectional area of the circular heat exchanger, and extending axially and longitudinally between sections A, B and C. It will also be noted that the detuning plates 50*a* and *c* in sections A and C are located in the upper portion of the circular cross-section, while the detuning plate 50*b* in section B is located below the axial center line of the exchanger.

As more clearly shown in FIG. 1, the alternating pattern of detuning plates 50*a* and 50*b*, which correspond to the detuning plates 22 and 24 schematically shown in FIG. 1, would be sufficient to prevent or destroy standing waves of the first and second harmonics, and probably of the third harmonic as well. However, it is not always possible to accurately detect not only the number of harmonics which have amplitudes sufficient to cause damage to the tubes, but it is more difficult to determine the radial orientation of the standing wave of whatever harmonic is detected to have a serious amplitude. Accordingly, the present invention includes the addition, where necessary, of further detuning plates 18 and 20 which are positioned to extend at right angles to plates 22 and 24. Thus; if detuning plates 18 and 20 were shown in FIG. 3, they would extend vertically in the same direction as vertical rods 30. It should be understood that the location of the vertical detuning plates may be in alternate sections of the heat exchanger, in which case, only every other section would have a horizontal detuning plate and the intermediate sections would have a vertical detuning plate. However, where more severe acoustical harmonics are detected, the present invention includes the provision of a pair of vertical and horizontal detuning plates in each of the sections of the exchanger.

As shown most clearly in FIG. 3, the detuning plates 50*a*, *b*, and *c* are physically accommodated in the spaces between the tubes 26 which are provided by the horizontal rods 28. Similarly, the vertically extending detuning plates may be accommodated in the spaces between tubes 26 provided by vertical rods 30. The diameter of conventional rods, both horizontal and vertical, is in the order of $\frac{1}{4}$ to $\frac{1}{2}$ inch such that detuning plates having thicknesses in the range of $\frac{1}{8}$ to $\frac{1}{2}$ inch may be in-corporated in new exchanges, or retrofitted in existing exchangers without any change in the design, number of tubes or the tube spacing, and for most exchangers this thickness is entirely sufficient. However, as new exchangers are constantly increasing in size, i.e. in both diameter and axial length, it might be necessary in very large exchangers to utilize detuning plates having a thickness greater than $\frac{1}{2}$ inch in order to be structurally rigid enough to withstand and prevent the most severe acoustical waves and vibrations. In that situation, the support rods may be of increased diameter, such as up to one inch in diameter, in order to span the large diameter of the exchanger without sagging or vibrating. In that case, it will be apparent that the thickness of the detuning plates may be increased up to the one inch spacing between the tubes provided by such thicker support rods.

Figure 4:
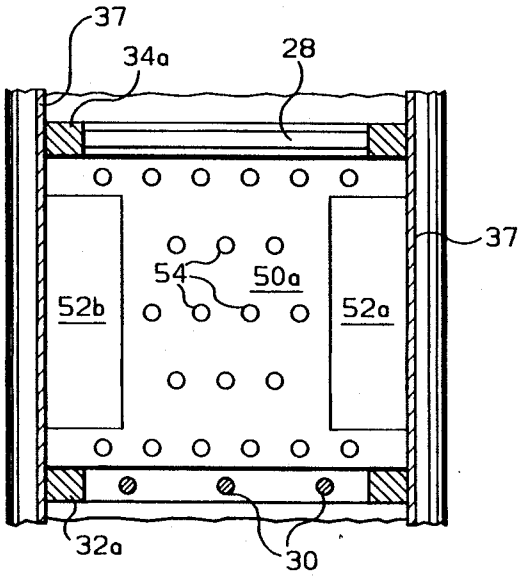
FIG. 4 is a sectional view taken along view line 4—4 of FIG. 3.

Turning to FIG. 4, one preferred embodiment of the detuning plates of the present invention provides for the welding, or other securement, of the edges of the detuning plates to the adjacent baffle rings supporting the rods, and the detuning plate itself may be provided with rectangular openings 52*a* and 52*b*, as well as an appropriate number and size of holes 54 for decreasing the maldistribution of the flow of the fluid medium flowing through the shell side of the exchanger. Whether or not the detuning plates are provided with either such rectangular openings 52 or any holes 54, it will be noted that the axial flow path of the shell-side fluid is only presented with the edge of the detuning plates as an obstruction to the flow. Accordingly, the provision of the rectangular and circular openings is to improve the cross flow of the heat exchanger fluid perpendicular to the plane in which such detuning plates are located. The holes 54 may be in the range of $\frac{1}{4}$ to $\frac{3}{4}$ of an inch in diameter, and the openings 52 may be in order of 4–6 inches inwardly of the shell and of any desired axial length.

From the foregoing description, which is intended to be purely illustrative of the principles of the invention and in no way exhaustive thereof, it will be apparent that the present invention provides for the effective elimination of the potentially dangerous acoustical standing waves of any harmonic having an amplitude sufficient to cause damage to the tubes, and such detuning plates may be retrofitted into existing rodbaffle heat exchangers as well as incorporated in new ones under construction. Accordingly, the present invention solves the serious and long standing problem of possible damage to the tubes caused by the unpredictable occurrence of acoustical standing waves in heat exchangers.

That which is claimed is:

1. A rodbaffle heat exchanger having an axial centerline and comprising a plurality of rodbaffle means spaced along the axial, longitudinal length of said heat exchanger and defining a plurality of sections of said heat exchanger therebetween along its axial, longitudinal length, a plurality of tubes supported by said rodbaffle means, and a plurality of separate acoustical detuning plate means, positioned in said plurality of heat exchanger sections for preventing damage to said heat exchanger from the formation of acoustical stading waves is said heat exchanger, and wherein said plurality of separate acoustical detuning plate means are alternately positioned to extend along different chords of said heat exchanger in different heat exchanger sections thereof.

2. The rodbaffle heat exchanger as claimed in claim 1 wherein some of said plurality of separate acoustical detuning plate means extend along chords in a first direction across the circular cross-section, and others of said plurality of separate acoustical detuning plate means extend along chords in a second, different direction across the circular cross-section of said heat exchanger.

3. The rodbaffle heat exchanger as claimed in claim 2 wherein said first and second directions are at right angles to each other.

4. A rodbaffle heat exchanger comprising a plurality of rodbaffle means spaced along the axial, longitudinal length of said heat exchanger and defining a plurality of sections of said heat exchanger therebetween along its axial, longitudinal length, a plurality of tubes supported by said rodbaffle means, and a plurality of separate acoustical detuning plate means positioned in said plurality of heat exchanger sections for preventing damage to said heat exchanger form the formation of acoustical standing waves in said heat exchanger wherein a pair of said plurality of separate acoustical detuning plates means are positioned in each heat exchanger section of said heat exchanger where standing acoustical waves would otherwise occur, said plurality of separate acoustical detuning plates means extending along said axial, longitudinal length of said heat exchanger and one of said pair of said plurality of separate acoustical detuning plate means extends in a different direction than that of the other of said pair in each heat exchanger section.

5. The rodbaffle heat exchanger as claimed in claim 1 in which said plurality of separate acoustical detuning plate means are alternately positioned on different sides of the axial centerline of said heat exchanger in alternate heat exchanger sections thereof.

6. The rodbaffle heat exchanger as claimed in claim 5 in which said plurality of separate acoustical detuning plate means are alternately positioned at right angles to each other in alternate heat exchanger sections of said heat exchanger.

7. A heat exchanger having tube means for the passage of a first fluid within said tube means, and a shell side comprising the spaces between said tube means within a surrounding shell, a plurality of acoustical detuning plate means individually located and extending through different portions of said heat exchanger, and each of said plurality of acoustical detuning plate means having a plurality of passage means extending therethrough for permitting the flow of shell-side fluid through said plurality of acoustical detuning plate means.

8. The heat exchanger as claimed in claim 7 wherein individual acoustical detuning plate means extend through different portions of said heat exchanger on different sides of the axial center line of said heat exchanger.

9. The heat exchanger as claimed in claim 8 wherein a first plurality of said acoustical detuning plate means extend across said heat exchanger from one side of said shell to the other in a first direction, and a second plurality of said acoustical detuning plate means extend in a second, different direction across said heat exchanger form one side of said shell to the other side of said shell.

10. The heat exchanger as claimed in claim 7 wherein a plurality of holes are provided in said plurality of acoustical detuning plate means.

11. The heat exchanger as claimed in claim 10 wherein the diameter of said plurality of a hole is in the range of $\frac{1}{4}$ to $\frac{3}{4}$ of an inch.

12. The heat exchanger as claimed in claim 7 wherein a plurality of rectangular openings are provided in said plurality of acoustical detuning plate means.

13. A rodbaffle heat exchanger comprising a plurality of rodbaffle means spaced along the axial, longitudinal length of said heat exchanger and defining a plurality of sections of said heat exchanger therebetween along its axial, longitudinal length, a plurality of tubes supported by said rodbaffle means, and a plurality of separate acoustical detuning plate means positioned in said plurality of heat exchanger sections extending along said axial, longitudinal length for preventing damage to said heat exchanger from the formation of acoustical standing waves in said heat exchanger wherein said heat exchanger has a substantially circular cross-section and said plurality of separate acoustical detuning plate means alternately extend along different chords of said substantially circular cross-section of said heat exchanger in different heat exchanger sections thereof.

* * * * *

UNITED STATES PATENT AND TRADEMARK OFFICE

CERTIFICATE OF CORRECTION

PATENT NO. : 5,058,664

DATED : October 22, 1991

INVENTOR(S) : Cecil C. Gentry

It is certified that error appears in the above-identified patent and that said Letters Patent is hereby corrected as shown below:

Column 5, claim 1, lines 20 and 21 the phrase "stading waves is said" should be corrected to read ---standing waves in said---.

Signed and Sealed this

Twenty-seventh Day of September, 1994

*Attest:*

*Attesting Officer*

Bruce Lehman

BRUCE LEHMAN

*Commissioner of Patents and Trademarks*